US006688850B2

(12) United States Patent
Bucher et al.

(10) Patent No.: US 6,688,850 B2
(45) Date of Patent: Feb. 10, 2004

(54) HOOK AND FOLD CEILING FAN BLADES

(75) Inventors: Charles E. Bucher, Valrico, FL (US); John C. Bucher, Ft. Lauderdale, FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/858,220

(22) Filed: May 15, 2001

(65) Prior Publication Data

US 2002/0172598 A1 Nov. 21, 2002

Related U.S. Application Data

(60) Continuation-in-part of application No. 09/405,676, filed on Sep. 24, 1999, now Pat. No. 6,352,411, which is a continuation-in-part of application No. 09/200,607, filed on Nov. 30, 1998, now Pat. No. 6,171,059, which is a division of application No. 08/851,501, filed on May 5, 1997, now Pat. No. 6,010,306.

(51) Int. Cl.[7] ..... F04D 29/36

(52) U.S. Cl. ..... 416/210 R; 416/220 A

(58) Field of Search ..... 416/5, 142, 210 R, 416/205, 206, 207, 220 A, 221; 29/889.1, 889.3, 889.6, 457

(56) References Cited

U.S. PATENT DOCUMENTS

| | | | | | |
|---|---|---|---|---|---|
| 2,771,259 | A | | 11/1956 | Laystrom | 248/28 |
| 2,965,180 | A | | 12/1960 | Killam | 416/210 |
| 4,050,771 | A | | 9/1977 | Watson | 339/263 |
| 4,121,495 | A | | 10/1978 | Malo | 85/1 |
| 4,511,310 | A | | 4/1985 | Pearce | 416/134 |
| 5,180,284 | A | * | 1/1993 | Monrose et al. | 416/206 |
| 5,397,206 | A | | 3/1995 | Sihon | 411/544 |
| 5,462,412 | A | | 10/1995 | Scofield | 416/210 |
| 5,873,701 | A | | 2/1999 | Shiu | 416/205 |
| 5,927,945 | A | | 7/1999 | Chen | 416/5 |
| 5,944,486 | A | * | 8/1999 | Hodgkins, Jr. | 416/210 R |
| 5,944,487 | A | | 8/1999 | Pearce | 416/244 |
| 5,951,197 | A | | 9/1999 | Wu | 403/315 |
| 5,954,449 | A | | 9/1999 | Wu | 403/315 |
| 5,980,353 | A | | 11/1999 | Wu | 446/210 |
| 6,010,306 | A | | 1/2000 | Bucher et al. | 416/210 |
| 6,027,309 | A | | 2/2000 | Rawls | 416/5 |
| 6,027,310 | A | | 2/2000 | Kerr | 416/210 |
| 6,039,540 | A | | 3/2000 | Wu | 416/210 |
| 6,059,531 | A | * | 5/2000 | Tai | 416/220 A |
| 6,095,753 | A | | 8/2000 | Hsu | 416/207 |
| 6,149,388 | A | * | 11/2000 | Liao | 416/221 |
| 6,213,716 | B1 | | 4/2001 | Bucher | 416/142 |
| 6,261,064 | B1 | * | 7/2001 | Tang | 416/205 |
| 6,347,924 | B1 | * | 2/2002 | Chang | 416/210 R |

FOREIGN PATENT DOCUMENTS

| | | | |
|---|---|---|---|
| GB | 2 276 219 | 9/1994 | 267/141 |

* cited by examiner

*Primary Examiner*—Edward K. Look
*Assistant Examiner*—Igor Kershteyn
(74) *Attorney, Agent, or Firm*—Brian S. Steinberger; Law Offices of Brian S. Steinberger, P.A.

(57) ABSTRACT

Hook on and lock blades for ceiling fans. Hooks on either end portions of blades, on mounting arms or on rotors adjacent to the ceiling fan motors allow the blades to easily hook onto the motor assembly. Folding down the blade causes at least one lock to exist that restricts lateral movement between the blade and the motor. There are various types of techniques for locking the blades to the arms that can include tightly positioning a portion of one connector between two raised edges and/or walls of another connector. Additionally, the locking techniques can use snapably mateable male and female type fasteners, and the like, where the techniques restrict any lateral movement between the blades and the motor. The invention does not need removable fasteners such as screws and the like, to assemble the blades onto the ceiling fan. The hook and lock blades can be reversibly mounted allowing for greater versatility.

15 Claims, 8 Drawing Sheets

210
212A
212B
242
244
224
S
222
220
223
240
200

HOOK AND FOLD CEILING FAN BLADES

This invention is a Continuation in part of Ser. No. 09/405,676 filed Sep. 24, 1999, now U.S. Pat. No. 6,352,411 which is a Continuation-In-Part of application Ser. No. 09/200,607 filed on Nov. 30, 1998, now U.S. Pat. No. 6,171,059 which is a Divisional of Ser. No. 08/851,501 filed May 5, 1997, now U.S. Pat. No. 6,010,306, all by the same inventors and assignee as the subject application which are all incorporated by reference, and this invention relates to ceiling fans, and in particular to ceiling fans having reversible blades that hook on and fold out to locked positions during assembly, and this invention is related to pending application Ser. No. 09/989,827 filed Nov. 21, 2001 which is a Divisional of Ser. No. 09/708,291 filed Nov. 8, 2000, now U.S. Pat. No. 6,336,792 which is a Divisional of Ser. No. 09/200,607 filed Nov. 30, 1998, now U.S. Pat. No. 6,171,059 which is a Divisional of Ser. No. 08/851,501 filed May 5, 1997, now U.S. Pat. No. 6,010,306, all by the same inventors and assignee as the subject application which are all incorporated by reference, and this invention relates to U.S. Pat. No. 6,213,716 to Bucher et al., the same inventors and assignees, which is incorporated by reference.

BACKGROUND AND PRIOR ART

Conventional ceiling fans that are shipped in cartons have separate packing materials such as foam inserts for the many components that must be assembled by the installer to hang the ceiling fan. For example, ceiling fan blades are generally shipped in detached positions and are fastened onto the motors and ceiling fan arms by screw type fasteners during the assembly process, a practice having many inherent problems.

A single conventional ceiling fan blade has often required some five screw type fasteners to attach the blade to the motor/arm of the ceiling fan. Thus, a five blade ceiling fan can have some twenty five screw type fasteners just for attaching the fan blades to the motor and arm assembly. Clearly, problems occur when any of this small screw type fasteners become lost and/or missing during the assembly process.

In addition to having multiple loose parts, a typical installer must follow a tedious process in order to assemble and hang the ceiling fan. In FIG. 1, a conventional ceiling fan motor housing 10 has a rotor component 20 that rotates about a central axis within a motor housing 10, which in turn is connected to a hanger assembly 5 that is attached beneath a ceiling 2. A plurality of fan blades 30 can be connected to the rotor 20 by mounting arms 40. Each mounting arm 40 has one end 42 connected to an end 32 of each fan blade 30, and an opposite second end 44 having at least two through-holes 45 therethrough, so that conventional screw type fasteners 50 can pass through the through-holes 45 to mateably thread into threaded holes 25 in the bottom of rotor 20.

It is usual in many ceiling fan installation directions to have the installer first connect and hang the motor housing 10, rotor 20 and hanger assembly 5 to a ceiling by having the installer standing on a raised platform such as a ladder or stool. Next, the installation directions have the installer attach the blades 30 to their respective mounting arms/motor connectors 40. Finally, a last step is to connect the blade 30 and respective mounting arm 40 to the rotor 20 on the motor housing 10.

This final assembly step takes great dexterity, patience, balance and time for the installer. In order for a single person

60 to be able to complete this final step, the installer 60 needs to hold in one hand 62 the fan blade 30 and already attached mounting arm 40, and to position a screwdriver 70 to the heads of the screws 50 with the other hand 64. The installer must be able to balance the mounting screws 50 on the tip of the screw driver 70, insert the screws upwardly through the holes 44 in the mounting arm, making sure not to accidentally drop the screws 50 and then screw the screws 50 into the mating holes 25 on the rotor 20 all while still holding the blade 30 and arm 40. This assembly requires the installer to have to constantly hold both hands 62 and 64 raised high above their head, while again standing on the ladder or stool.

This tedious traditional process of assembly and installation causes many potential problems. First, the screw type fasteners can and do accidentally fall and become lost causing more time and expense to finish the installation. The installer 60 often has to constantly reposition the blade 30 and arm 40 in order to be able to properly line up the through-holes 45 in the mounting arms 40 with their respective mating holes 25 in the bottom of rotor 20. Also, the blade 30 and mounting arm 40 have been known to fall on and cause injury to the installer 60 during assembly. Furthermore, the installers can lose their balance and injure themselves by falling off the ladder or stool.

The use of screws has other inherent problems as to their appearance. The screw type fasteners are often visible from those looking up at the running ceiling fans. Visible screws are unsightly and further detract from the appearance of the ceiling fan itself.

Still additional problems have been known to occur after installation of the screw type fasteners. For example, uneven tightening of each of the plural screw type fasteners that connect the blades to the mounting arms has resulted in wobble effects when the ceiling fan is running.

Another problem occurs as a result of the need to clean blades over time in order to remove dirt and dust buildup. Current techniques have relied on manually holding brushes to the ceiling fan attached blades themselves which inherently tires the muscles in the cleaner's back, neck, shoulders, arms and hands. Furthermore, this messy cleaning operation with brushes while the blades are attached to the ceiling fan mounted motor often results in dirt and debris falling on both the cleaner and furniture and flooring below the ceiling fan.

Another problem occurs when the ceiling fan is taken down to be reboxed. In order to be repackaged, each and every component must be disassembled, a time consuming endeavor, which also can result in many loose parts becoming misplaced and lost over time.

Various solutions to changing some of the traditional attachment methods have been proposed that have additional problems. U.S. Pat. No. 5,944,486 to Hodgkins, Jr. describes an "Interchangeable Fan Blade System", title. However, generally all of the embodiments shown require some screw type fasteners be used that still would have many of the problems described above. Furthermore, the slots shown in FIGS. 2, 3 and 9, and adapter plates shown in FIGS. 5A–5G would have problems in fixably securing the blades to the adapters so that the blades would not wobble nor rattle when being run during a ceiling fan use. For example, the hook arm in FIG. 5D would not by itself adequately secure the fan blades in position by solely relying on a "centrifugal force." Besides the wobble and rattle problems, each time the ceiling fan stops the hooked on blades can potentially fall off and become damaged as well as injure those beneath the ceiling fan. Similarly the "pin" supported blades of FIG. 5F would also wobble and rattle for not being properly secured to the mounting arms. In addition, these "pins" can inherently become loose and cause the blades to possibly fall off, become damaged and possibly injure those beneath the ceiling fan. Thus, the need exists for solutions to the above problems.

SUMMARY OF THE INVENTION

A first objective of the subject invention is to provide ceiling fan blades that can be easily and quickly attached onto a ceiling fan mounted motor without using removable fasteners such as screws and the like.

The second objective of the subject invention is to provide mountable ceiling fan blades that become instantly aligned when being mounted.

The third objective of the subject invention is to provide ceiling fan blades that do not rattle nor wobble when being run on a ceiling fan.

The fourth objective of the subject invention is to provide ceiling fan blades that can be reversibly hung without using removable fasteners such as screws and the like.

Two embodiments of hook and fold blades are included. Both embodiments include a ceiling fan motor having a rotating member, a first mount attached to the rotating member, a first fan blade having a first interior end portion and a first exterior end portion, a first hook portion which hooks the first mount to the first interior end portion, and a lock portion for restricting lateral movement between the first mount and the first interior end portion, wherein gravity and centrifugal force further locks the first fan blade to the first mount. The first mount can be on the first fan blade arm, or on a portion of a rotor on the motor. The locking portion can include edges having a cavity therebetween, wherein a portion of the first hook portion becomes positioned and locked within the cavity. One embodiment has the first hook portion attached to and extending outward away from the first interior portion of the first blade. Another embodiment has the first hook portion attached to and extending outward away from the first mount attached to the rotating member. The first hook portion can be attached to the first interior portion of the first blade and extending to the first exterior portion of the first blade. The first hook portion can be attached to the first mount toward the rotating member. The blades can be reversible in at least one of the embodiments.

For both embodiments there is a novel method of attaching the ceiling fan blades without using any removable fasteners, that includes the steps of hooking one end of a fan blade to a mount attached to a ceiling fan motor, and locking the fan blade to the ceiling fan motor with at least one technique to eliminate any lateral movement between the fan blade and the mount. The techniques can include either or both inserting a narrow body portion to be tightly fit or mateably fit between two raised edges/walls/arms, and/or positioning a raised ridge type portion into a mateably receiving indentation.

Further objects and advantages of this invention will be apparent from the following detailed description of a presently preferred embodiment that is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

First Embodiment

This invention is related to U.S. Pat. No. 6,010,306 to Bucher et al. and U.S. Pat. No. 6,171,059 to Bucher et al.; and U.S. Pat. No. 6,213,716 to Bucher et al., each having the same inventors and assignee as the subject invention and each being incorporated by reference.

Figure 1:
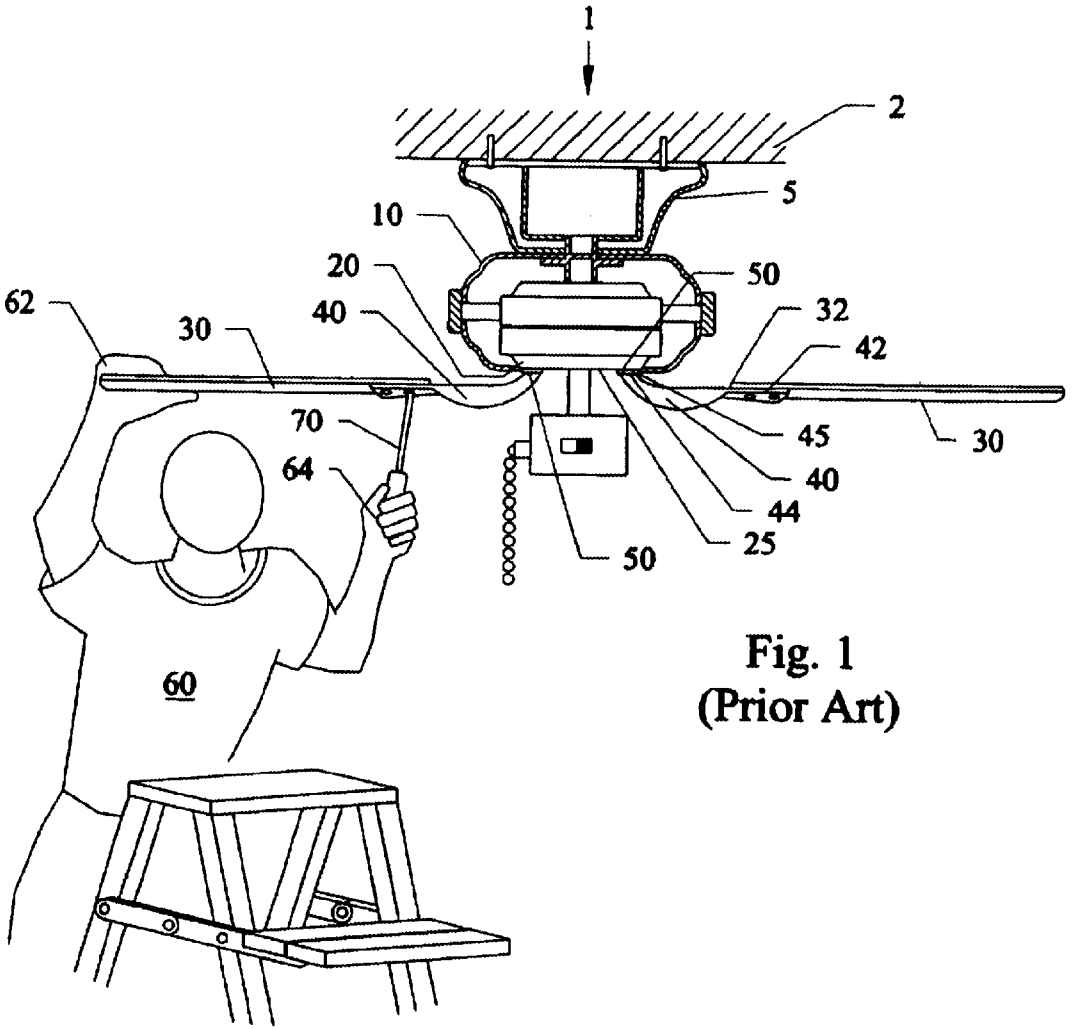
Fig. 1 (Prior Art)
FIG. 1 shows a prior art view of a blade with mounting arm attached to a ceiling fan motor and rotor.
Figure 2A:
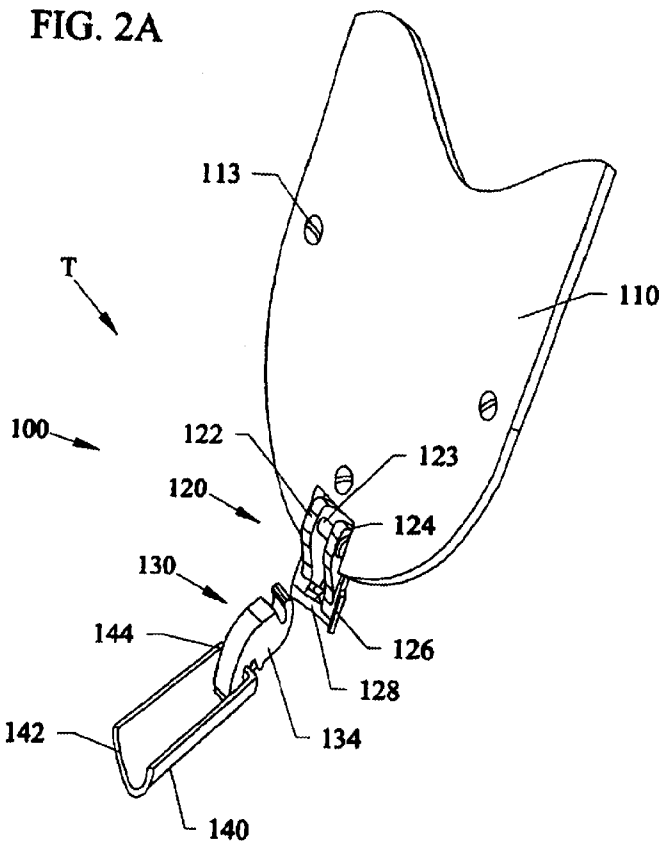
FIG. 2A is a perspective view of a first embodiment of the hook and fold ceiling fan blade with a blade ready to be attached to a motor/arm.
Figure 2B:
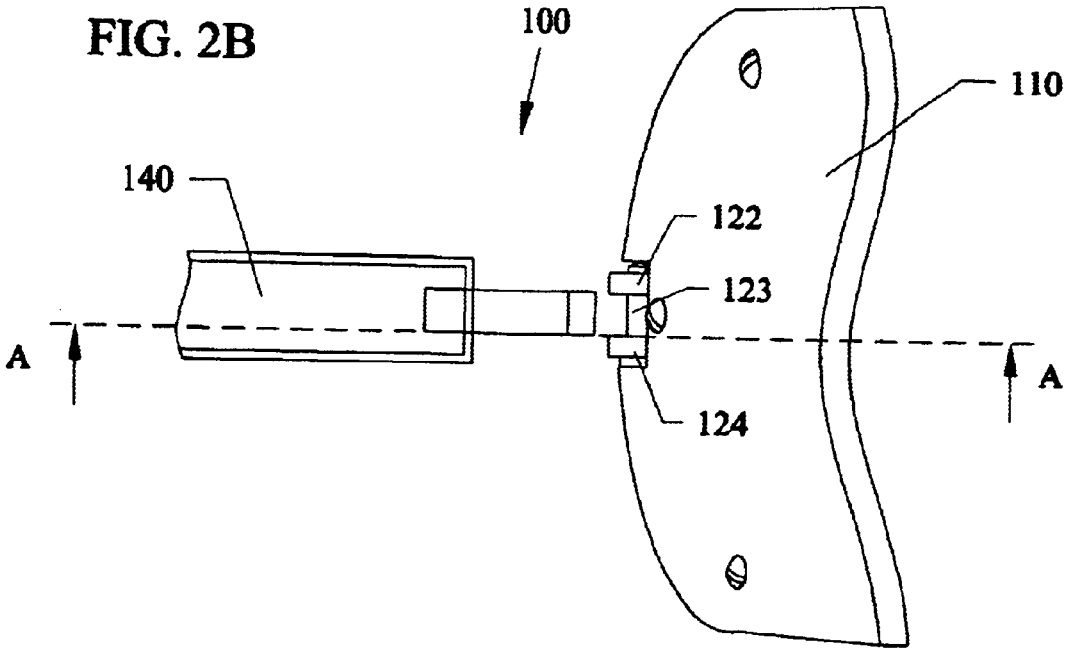
FIG. 2B is a top view of FIG. 2A along arrow T.
Figure 2C:
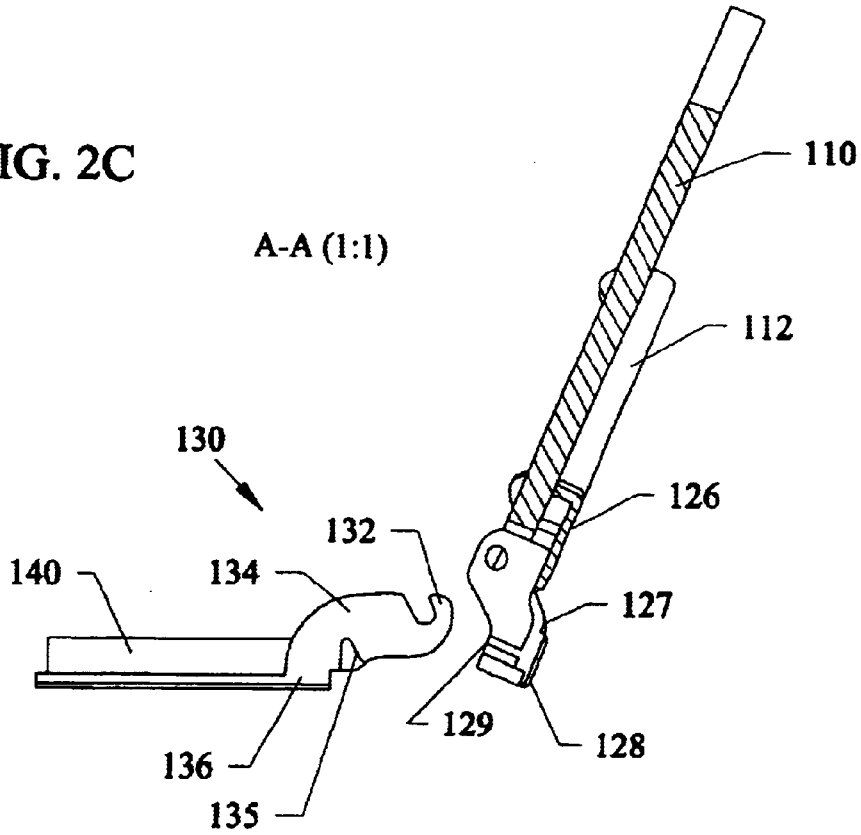
FIG. 2C is a side cross-sectional view of FIG. 2B along arrows A—A.

FIG. 2A is a perspective view of a first embodiment 100 of the hook and fold ceiling fan blade with a blade 1110 ready to be attached to a motor/arm 140. FIG. 2B is a top view of FIG. 2A along arrow T. FIG. 2C is a side cross-sectional view of FIG. 2B along arrows A—A. Referring to FIGS. 2A–2C, ceiling fan blade 110 can have a medallion cover 112, attached thereon with fasteners 112, such as screws, and the like. Attached to the medallion 112 can be a connector section 120 having two raised wall type members 122, 124 with a pin member 123 connected attached therebetween. The bottom of connector 120 has an upper bottom surface 126, which steps down at 127 to a lower bottom surface 128. A raised ridge type member 129 is positioned in front of wall members 122, 124. A ceiling fan motor arm 140 has one end 142 that can be attached to a motor/rotor 50 such as that shown in FIG. 1. Arm 140 can be a solid member or be hollow or have an open upper surface such as a half cylinder. The outer dimensions of the arm can be of any desired shape, such as but not limited to cylindrical, rectangular, and the like. The opposite end 144 of arm 140 can include a hook connector 130, having a hook portion 132 and a mid narrow raised body portion 134 that attaches the hook portion 132 to the arm 140. Hook connector 130 can be formed with arm 140 or be separately attached at end 136 by conventional fasteners such as screws, and the like. On the underside of hook connector 130 can be an indentation 135.

The subject invention can be assembled by initially hanging the ceiling fan motor as shown in FIG. 1, with the blades to be attached thereafter. The method of attaching the blade 110 to the motor/arm of the ceiling fan 140 will be described in reference to FIGS. 2C and 3–4.

Figure 6:
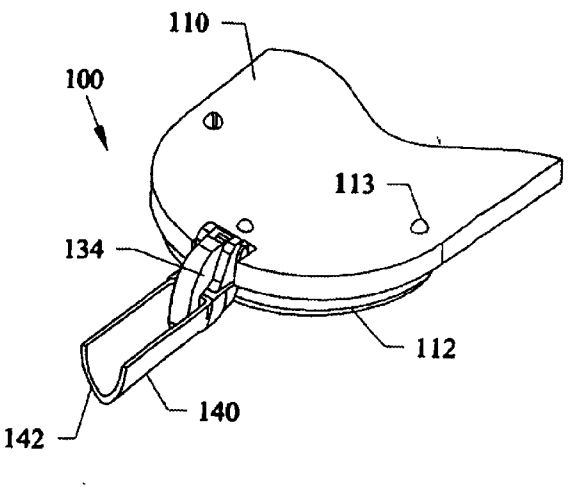
FIG. 6 is a perspective view of the preceding figures in a fully attached state.
Figure 3:
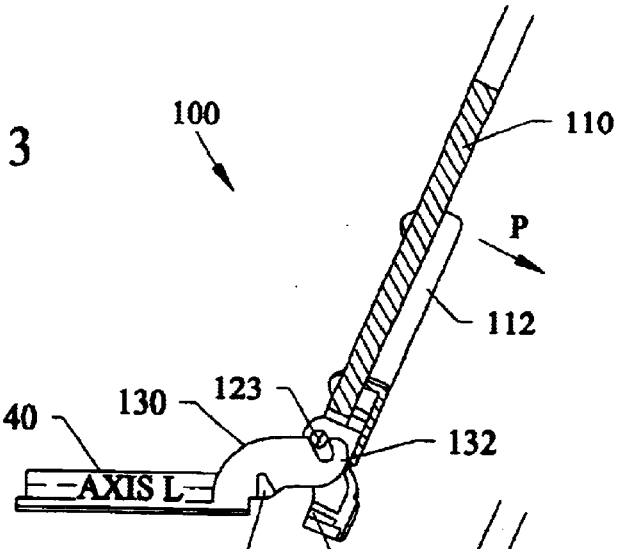
FIG. 3 is another view of FIG. 2C with the hook starting to be inserted about the pin.
Figure 4:
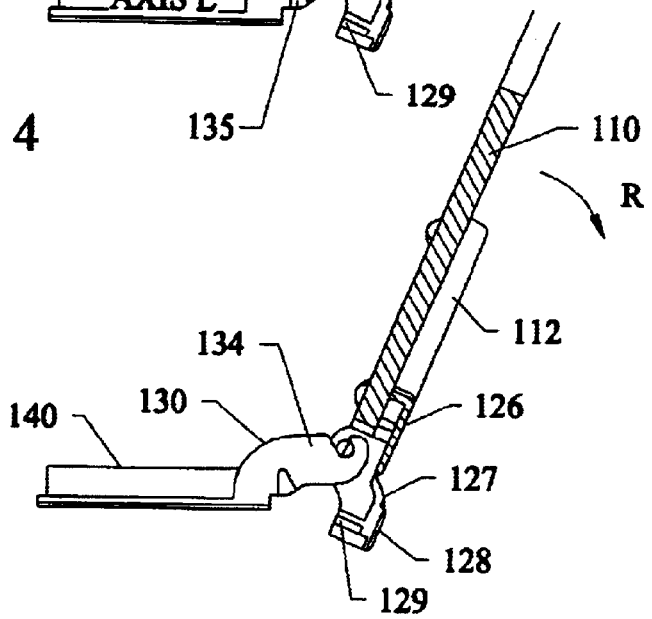
FIG. 4 is another view of FIG. 3 with the hook being fully wrapped about the pin.
Figure 5:
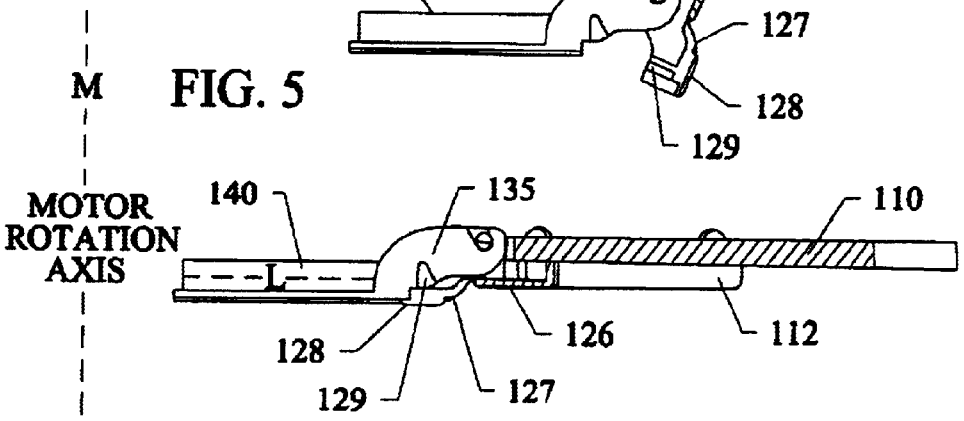
FIG. 5 is another view of FIG. 4 with the blade in a folded down position.

An installer can initially orient the blade 110 off axis to the longitudinal axis L, of the motor arm 140. FIG. 3 the hook portion 132 starting to be inserted about the pin 123. Next, the installer can pull or push the blade 110 in the direction of arrow P so that the hook portion 132 is fully attached. FIG. 4 is another view of FIG. 3 with the hook being fully wrapped about the pin. Finally, the blade 110 is folded down in the direction of arrow R. FIG. 5 is another view of FIG. 4 with the blade in a folded down position with the blade 110 in the same plane as the axis L of the arm 140. FIG. 6 is a perspective view of the final folded down position of the blade 110.

The two different techniques of locking the blade 110 to the arm 130 will now be discussed in reference to FIGS. 2A, 2B, 5 and 6. The narrow body portion 134 of hook connector 130 slides into and becomes sandwiched between the raised edges 122, 124 of connector 120. A tight sized space between edges 122, 124 allows for a tight fit when the narrow body portion 134 of hook connector 130 has been placed therein. The bottom uneven surface 134 of hook connector 130 abuts against the inner step surface 127 and inner lower bottom surface 128 of connector 120 to complete the first locking technique. A second locking technique occurs when raised ridge member 129 of connector 120 can become mateably seated into the indentation groove 135 of hook connector 130 locking the blade 110 to the arm 140. A tight and/or snap fit between the raised ridge member 129 and indentation groove 135 can also be used. Either or both locking techniques described will restrict any lateral (side-to-side) movement of the blade 110 relative to the arm 140. Although, the two locking techniques are shown the invention can be practiced with either one. Using both locking techniques acts as an extra safety feature to lock the blade 110 to the motor/arm 140.

Second Embodiment

Figures 7A, 11:
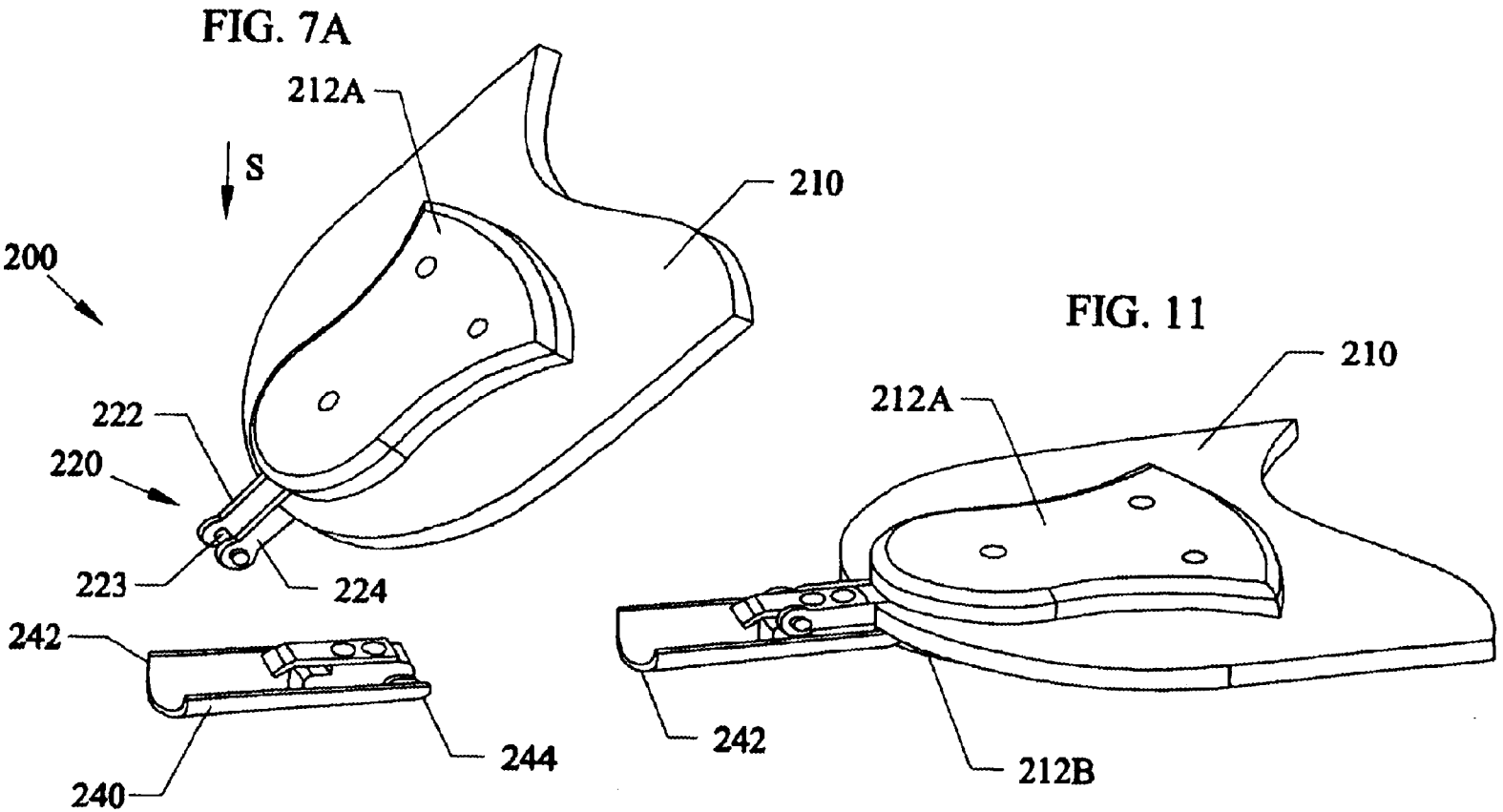
FIG. 7A is a perspective view of a second embodiment of the hook and fold ceiling fan blade with the blade ready to be attached to a motor/arm.
FIG. 11 is a perspective view of the second embodiment in a fully attached state.
Figure 7B:
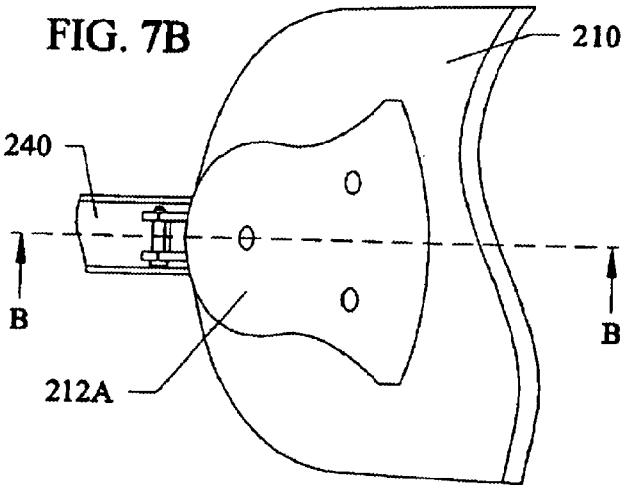
FIG. 7B is a top view of FIG. 7A along arrow S.
Figure 7C:
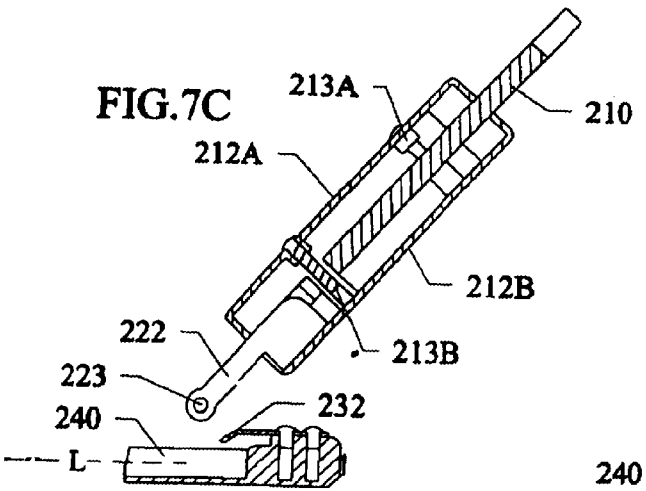
FIG. 7C is a side cross-sectional view of FIG. 7B along arrows B—B.

A second embodiment of the subject invention hook and lock blades will be described in reference to FIGS. 7A–14D. FIG. 7A is a perspective view of a second embodiment 200 of the hook and fold ceiling fan blade invention with the blade 210 ready to be attached to a motor/arm 240. FIG. 7B is a top view of FIG. 7A along arrow S. FIG. 7C is a side cross-sectional view of FIG. 7B along arrows B—B.

Figures 12A, 12B, 12C, 13A, 13B, 13C:
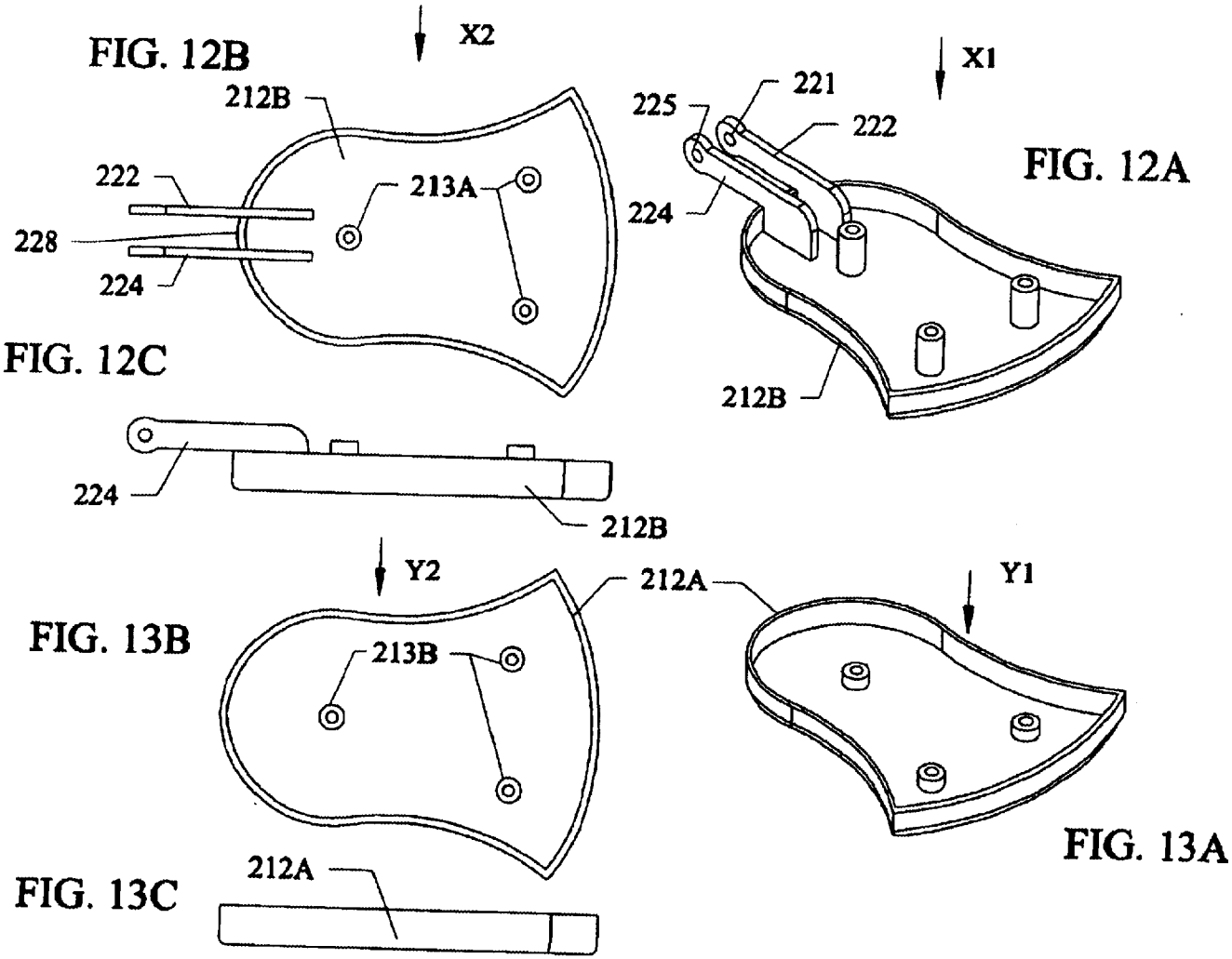
FIG. 12A is a perspective view of the lower medallion cover of the second embodiment.
FIG. 12B is a top view of the cover of FIG. 12A along arrow X1.
FIG. 12C is a side view of the cover of FIG. 12B along arrow X2.
FIG. 13A is a perspective view of the upper medallion cover of FIGS. 7A–11 without pin support arms.
FIG. 13B is a top view of the cover of FIG. 13A along arrow Y1.
FIG. 13C is a side view of the cover of FIG. 13B along arrow Y2.

FIG. 12A is a perspective view of the lower medallion cover 212B of the second embodiment 200. FIG. 12B is a top view of the cover 212B of FIG. 12A along arrow X1. FIG. 12C is a side view of the cover 212B of FIG. 12B along arrow X2. Referring to FIGS. 12A–12C, medallion cover 212B can include two arms 222 and 224 attached to and extending from a rear portion so that a rotation pin 223 can be fixably inserted into mounting holes 221, 225 so that pin 223 can be fixably attached to both arms 222 and 224.

FIG. 13A is a perspective view of the upper medallion cover 212A of FIGS. 7A–11 without pin support arms. FIG. 13B is a top view of the cover 212A of FIG. 13A along arrow Y1. FIG. 13C is a side view of the cover 212A of FIG. 13B along arrow Y2.

The upper medallion cover 212A can be attached to the lower medallion cover 212B by positioning and sandwiching both covers 212A and 212B about an end portion of the blade 210 and using press fit type fasteners 213A, 213B, where for example male prong portions 213A can be press fit into female receivers 213B holding the medallion covers 212A and 212B to blade 210. Alternatively, conventional screw type fasteners can be substituted for fasteners 213A and 213B. The two sided medallion covers 212A, 212B allow the second embodiment to be able to reverse the blade 210 during use. Thus, a blade 210 can be used that has different colors (i.e. black on one side and white on other side, wood grain on one side and solid color on other side, and the like)

Figures 14A, 14B, 14C, 14D:
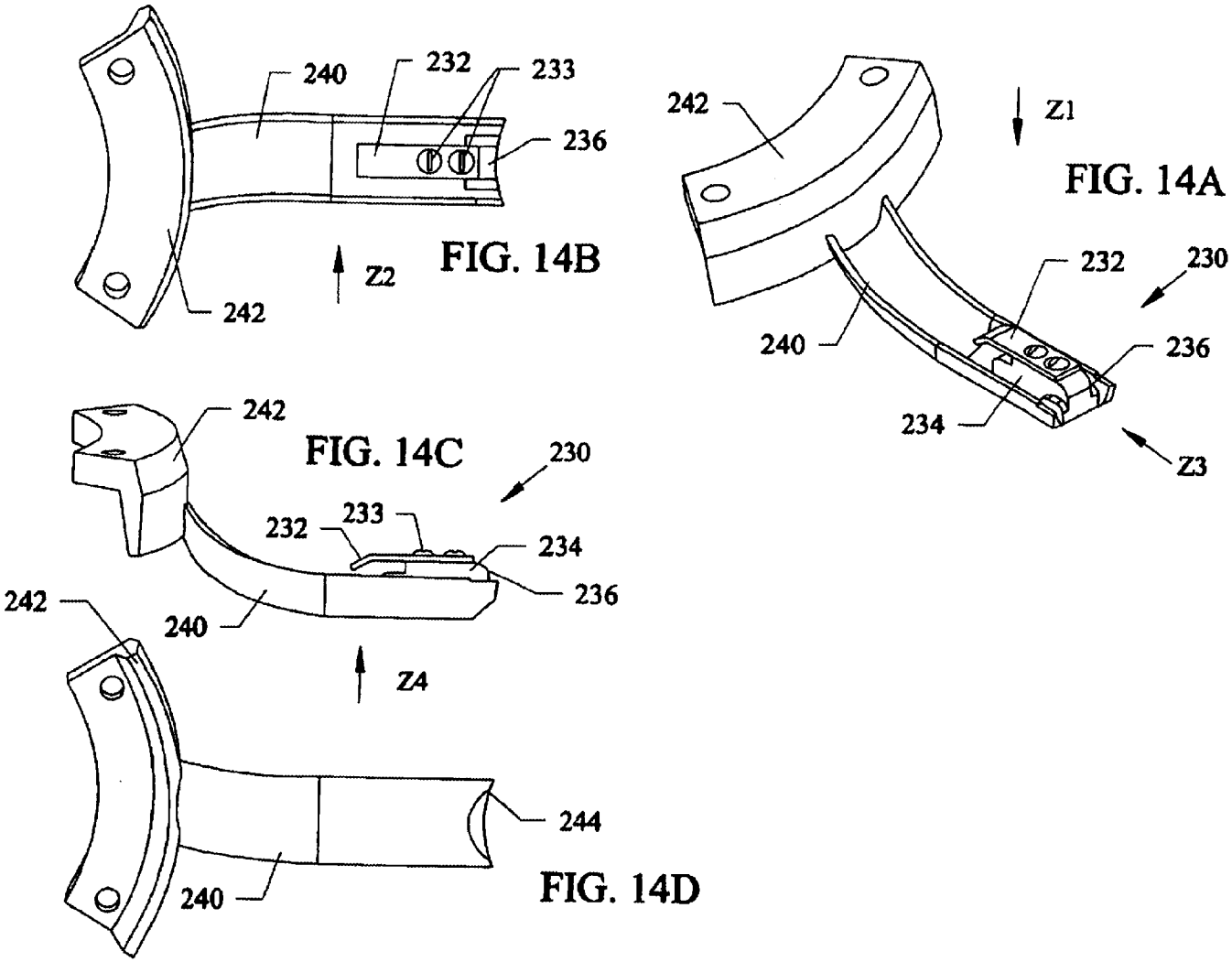
FIG. 14A is a perspective view of the arm and hook connector of the second embodiment.
FIG. 14B is a top view of FIG. 14A along arrow Z1.
FIG. 14C is a side view of FIG. 14B along arrow Z2.
FIG. 14D is a bottom view of FIG. 14C along arrow Z4.

FIG. 14A is a perspective view of the arm 240 and hook connector 230 of the second embodiment 200. FIG. 14B is a top view of FIG. 14A along arrow Z1. FIG. 14C is a side view of FIG. 14B along arrow Z2. FIG. 14D is a bottom view of FIG. 14C along arrow Z4. Referring to FIGS. 14A–14D, hook connector 230 includes a hook portion 232 facing toward the motor end 242 of arm 240, with the hook portion attached by fasteners 233 such as screws and the like, to a narrow raised body portion 234 with a uneven surface 236 facing toward the blades 210. The hook connector 230 can be fixably attached to the arm 240 by being molded into the arm, or attached by conventional fasteners (not shown) such as screws and the like.

The second embodiment 200 of the subject invention can be assembled by initially hanging the ceiling fan motor as shown in FIG. 1, with the blades to be attached thereafter. The method of attaching the blade 210 to the motor/arm 240 of the ceiling fan will be described in reference to FIGS. 7C and 8–10.

Figure 8:
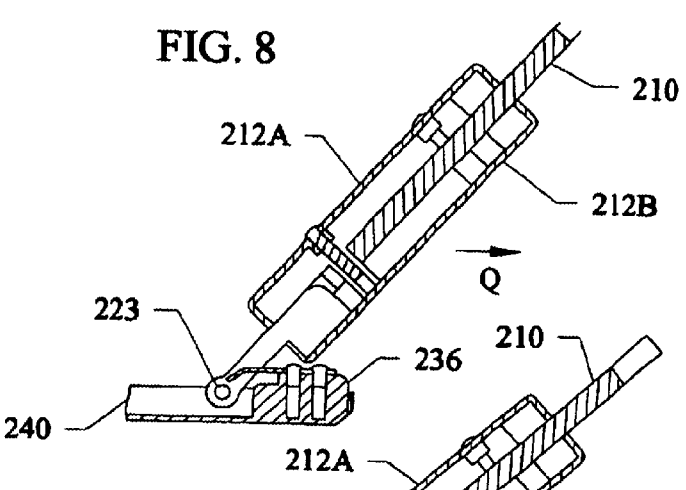
FIG. 8 is another view of FIG. 7C with the hook starting to be inserted about the pin.
Figure 9:
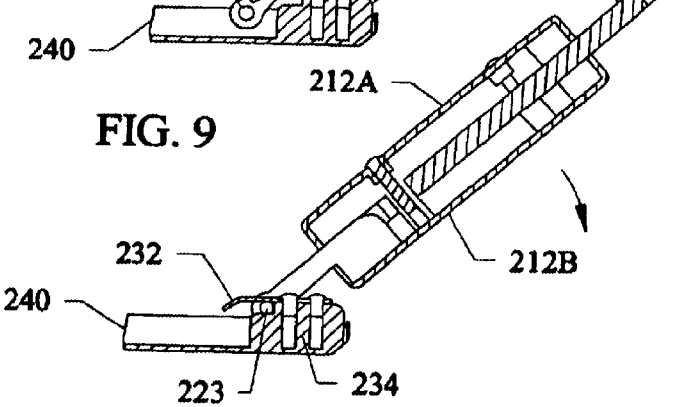
FIG. 9 is another view of FIG. 8 with the hook being fully wrapped about the pin.
Figure 10:
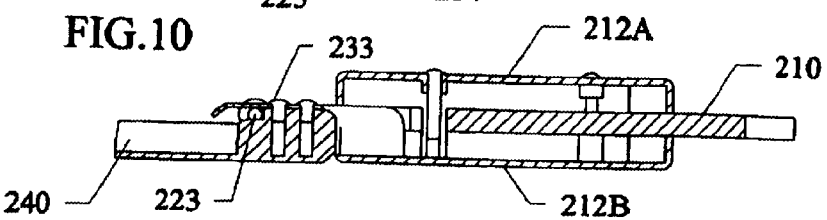
FIG. 10 is another view of FIG. 9 with the blade in a folded down position.

An installer can initially orient the blade 210 off axis to the longitudinal axis L, of the motor arm 240. FIG. 8 is another view of FIG. 7C with the hook portion 232 starting to be inserted about the pin 223. Next, the installer can pull or push the blade 210 in the direction of arrow Q so that the hook portion 232 is fully attached. FIG. 9 is another view of FIG. 8 with the hook portion 232 being fully wrapped about the pin 223. Finally, the blade 210 is folded down in the direction of arrow S. FIG. 10 is another view of FIG. 9 with the blade 210 in a folded down position with the blade 210 in the same plane as the axis L of the arm 240. FIG. 11 is a perspective view of the second embodiment 200 in a fully attached state.

Similar to the first embodiment 100, there is at least one locking techniques for locking the blade 210 to the arm 240. The narrow body portion 234 of hook connector 230 slides between and becomes sandwiched in the space between the two arms 222, 224 of connector 220. A tight sized space between arms 222, 224 allows for a tight fit when the narrow body portion 234 of hook connector 230 has been placed therein. The bottom surface 245 (shown more clearly in FIG. 14D) on both sides of narrow body portion 234 of hook connector 230 abuts against the bottom of the arms 222, 224 of connector 220 to complete the locking step. Although not shown a second locking technique similar to the one described in reference to the first embodiment can also be used in the second embodiment. For example, a raised ridge and mateable indentation can be on either the rear surface 236 of hook connector 230 and surface 228(FIG. 12B), respectively, and vice versa.

While the preferred embodiments describe attaching ceiling fan blades while the motor has been previously hung on a ceiling, the blades can be attached before the motor is hung so that the entire ceiling fan and blades can be hung together from the ceiling.

Although the preferred embodiments show the arms of the motor having hook connectors thereon, the rotating portion of the motor such as the rotor can have the hook connectors thereon instead of the arms. Still additionally, the blade ends can have the hook connectors thereon. Still additionally, a portion of the blades can protrude therefrom with hook connectors. Still additionally, the lock connectors can be located on portions of the rotor adjacent to the motor, the lock connectors can be located on the blade ends, and on protruding portions of the blades. Additionally, the hook and lock members can be integrated to be inside of the edges of the rotor, inside of the outer edges of the blade, and the like.

Although the preferred embodiments show the hook and lock connectors on the upper surface portions of the blades and arms, the hook and loop connectors can be positioned on the sides of these components, or on the bottom of these components, as needed.

While the locking techniques are shown with one component on one member and another component on another member, the component locations can be switched and their locations can be varied as desired and needed for the particular application used.

Additionally, the hook and lock blades can be easily removed by reversing any of the assembly steps described in reference to the embodiments described above.

Although the hook connectors and lock connectors are shown as being formed from separate piece components, the hook and lock connectors can include less and more components, and also be formed from injection molded plastic and the like, where the components are formed with the rotors or the arms or the blades or on protruding portions of the blades, and the like. For example, although some fasteners are shown for some of the pre-attached components in the preceding figures, some or all of these fasteners can be eliminated as needed by techniques such as injection molded plastics, and the like.

The subject invention can also be packed and stored in similar boxes and packaging as U.S. Pat. No. 6,213,716 to Bucher et al., the same assignees and inventors as that of the subject invention. For example, the blades of the subject invention can be stored vertically with their interior ends adjacent to the rotor/motor of the ceiling fans. Additionally, the subject invention fan blades can be laid in a sandwich pattern above, below or both above and below the motor component in a packing box.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan with clip on and fold out blades, comprising in combination:

a ceiling fan motor having a rotating member;

a first mount being a first blade arm attached to the rotating member;

a first fan blade having a first interior end portion and a first exterior end portion;

a first hook portion which hooks the first mount to the first interior end portion; and a lock portion for restricting lateral movement between the first mount and the first interior end portion, wherein gravity further locks the first fan blade to the first mount.

2. The coiling fan of claim 1, wherein the lock portion includes:

edges having a cavity therebetween, wherein a portion of the first hook portion becomes positioned within the cavity.

3. The ceiling fan of claim 1, wherein the first hook portion is attached to and extends out away from the first interior end portion of the first blade.

4. The ceiling fan of claim 1, wherein the first hook portion is attached to and extends out away from the first mount attached to the rotating member.

5. The ceiling fan of claim 1, wherein the first hook portion is attached to first interior end portion of the first black and extends to the first exterior portion of the first blade.

6. The ceiling fan of claim 1, wherein the first hook portion is attached to the first mount toward the rotating member.

7. The ceiling fan of claim 1, wherein the first blade is reversible.

8. A method of attaching ceiling fan blades without any removable fasteners, comprising the steps of:

hooking one end of a single fan blade to a hook portion on a mount attached to a ceiling fan motor; and locking the fan blade to the ceiling fan motor to eliminate any lateral movement between the fan blade and the mount.

9. The method of claim 8, further providing the step of:

providing the mount be adjacent to the motor.

10. The method of attaching of claim 8, further comprising the step of:

reversing the blade.

11. The method of attaching of claim 8, wherein the hooking and locking steps are accomplished while the motor is attached to a ceiling.

12. A ceiling fan with clip on and fold out blades, comprising in combination:

a ceiling fan motor having a rotating member;

a first mount attached to the rotating member;

a first fan blade having a first interior end portion and a first exterior end portion;

a first hook portion which books the first mount to the first interior end portion, wherein the first book portion is attached to first interior end portion of the first blade and extends to the first exterior portion of the first blade; and a lock portion for restricting lateral movement between the first mount and the first interior end portion, wherein gravity further locks the first fan blade to the first mount.

13. A ceiling fan with clip on and fold out blades, comprising in combination:

a ceiling fan motor having a rotating member;

a first mount attached to the rotating member;

a first fan blade having a first interior end portion and a first exterior end portion, the first blade being reversible;

a first hook portion which hooks the first mount to the first interior end portion; and a lock portion for restricting lateral movement between the first mount and the first interior end portion, wherein gravity further locks the first fan blade to the first mount.

14. A method of attaching ceiling fan blades without any removable fasteners, comprising the steps of:

providing an arm between a ceiling fan motor and a first single fan blade;

hooking one end of the fan blade to the arm that is attached to a ceiling fan motor; and locking the fan blade to the ceiling fan motor to eliminate any lateral movement between the fan blade and the arm.

15. A method of attaching ceiling fan blades without any removable fasteners, comprising the steps of:

hooking one end of a single reversible fan blade to a mount attached to a ceiling fan motor; and locking the fan blade to the ceiling fan motor to eliminate any lateral movement between the fan blade and the mount.

* * * * *